United States Patent [19]

Pauly et al.

[11] 4,299,051

[45] Nov. 10, 1981

[54] MOUNTABLE WHEEL FOR TOY VEHICLE

[75] Inventors: Ronald R. Pauly, Mound; Thomas W. Good, Long Lake; John D. Hastings, Eden Prairie, all of Minn.

[73] Assignee: Tonka Corporation, Spring Park, Minn.

[21] Appl. No.: 831,858

[22] Filed: Sep. 9, 1977

[51] Int. Cl.[3] ..... A63H 17/26

[52] U.S. Cl. ..... 46/221; 301/118; 301/9 DH

[58] Field of Search ..... 46/221, 223; 301/111, 301/118, 63 PW, 63 DD, 9 DH, 9 S; 285/396

[56] References Cited

U.S. PATENT DOCUMENTS

| | | | |
|---|---|---|---|
| 121,841 | 12/1871 | Berndt | 301/118 |
| 2,323,813 | 7/1943 | Fred | 301/118 |
| 2,921,344 | 1/1960 | Carrico | 29/159.01 |
| 2,940,781 | 6/1960 | Erikson | 301/63 PW X |
| 2,955,884 | 10/1960 | Marshall | 308/190 |
| 2,973,226 | 2/1961 | Ellies | 301/37 P |
| 3,020,091 | 2/1962 | Solomon | 301/63 DD |
| 3,048,447 | 8/1962 | Klint | 301/63 PW |
| 3,062,254 | 11/1962 | Keefe | 152/7 |
| 3,158,404 | 11/1964 | Noakes | 301/63 DD |
| 3,214,220 | 10/1965 | Foster et al. | 301/63 DD |
| 3,218,757 | 11/1965 | Benkoe | 46/202 |
| 3,263,363 | 8/1966 | Doe | 46/221 |
| 3,264,780 | 8/1966 | Doe | 46/221 |
| 3,321,863 | 5/1967 | Maxam, Jr. | 46/221 |
| 3,360,300 | 12/1967 | Carter | |
| 3,387,894 | 6/1968 | Louik | |
| 3,408,770 | 11/1968 | Smolinski et al. | |
| 3,445,958 | 5/1969 | Johnson et al. | |
| 3,566,536 | 3/1971 | Baynes et al. | 46/221 |
| 3,592,510 | 7/1971 | Hatfield | |
| 3,604,756 | 9/1971 | Gruber | |
| 3,611,630 | 10/1971 | Adickes et al. | |
| 3,638,356 | 2/1972 | La Branche | 46/221 |
| 3,642,048 | 2/1972 | Powelelt | |
| 3,646,706 | 3/1972 | Adickes | |
| 3,656,531 | 4/1972 | Ross et al. | |
| 3,720,017 | 3/1973 | Ersilio | |
| 3,733,744 | 5/1973 | Hiltpold et al. | 46/221 X |
| 3,817,581 | 6/1974 | Maxam | 301/6 R |
| 3,894,776 | 7/1975 | Black | 301/63 DD |
| 3,895,844 | 7/1975 | Merbler | 301/5.7 |
| 3,907,370 | 9/1975 | Bard | |
| 3,924,352 | 12/1975 | Goldfarb et al. | 46/221 X |
| 3,952,786 | 4/1976 | Kreling et al. | |
| 3,963,361 | 6/1976 | Schenk | 301/111 X |
| 3,985,392 | 10/1976 | Bergmann et al. | 301/63 PW |
| 4,193,639 | 3/1980 | Pauly et al. | 46/221 X |

FOREIGN PATENT DOCUMENTS

| | | | |
|---|---|---|---|
| 273129 | 3/1930 | Italy | 301/9 S |
| 470465 | 8/1937 | United Kingdom | |
| 617047 | 1/1949 | United Kingdom | |
| 1080302 | 8/1967 | United Kingdom | |
| 1169398 | 11/1969 | United Kingdom | |
| 1355939 | 6/1974 | United Kingdom | |
| 1448603 | 9/1976 | United Kingdom | |
| 542889 | 1/1977 | U.S.S.R. | 285/396 |

*Primary Examiner*—Robert Peshock
*Assistant Examiner*—Mickey Yu
*Attorney, Agent, or Firm*—Norman P. Friederichs

[57] ABSTRACT

Disclosed is a demountable wheel suitable for use on toy vehicles. The demountable wheel includes a first member that is rotatably mounted in a permanent or semi-permanent arrangement on an axle. The wheel has a second member including a tire which is demountably supported on the first member.

11 Claims, 7 Drawing Figures

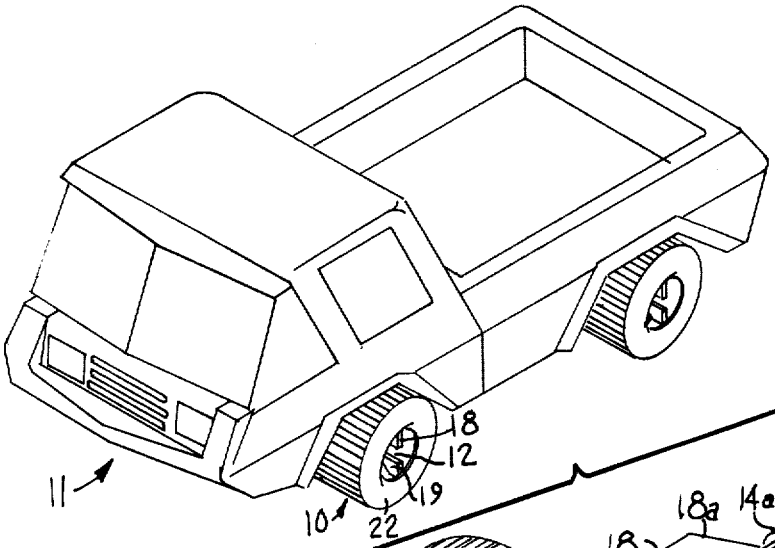
FIG. I
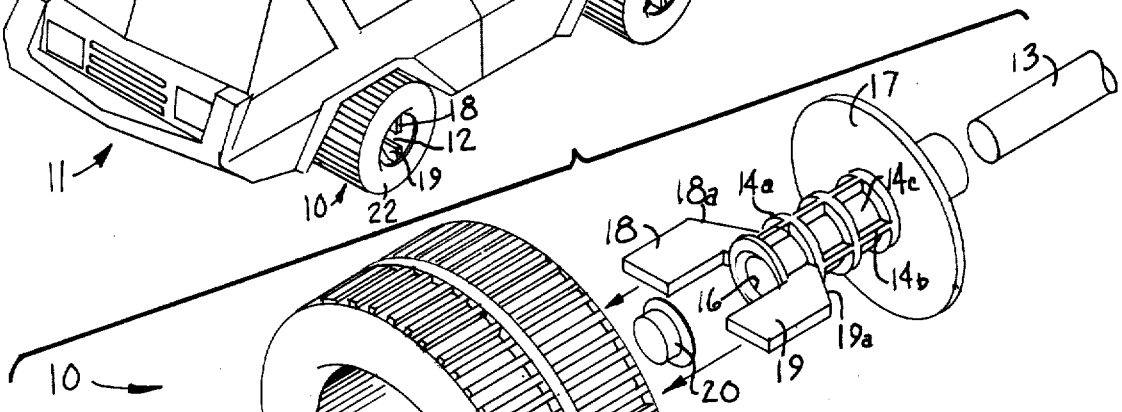
FIG. II
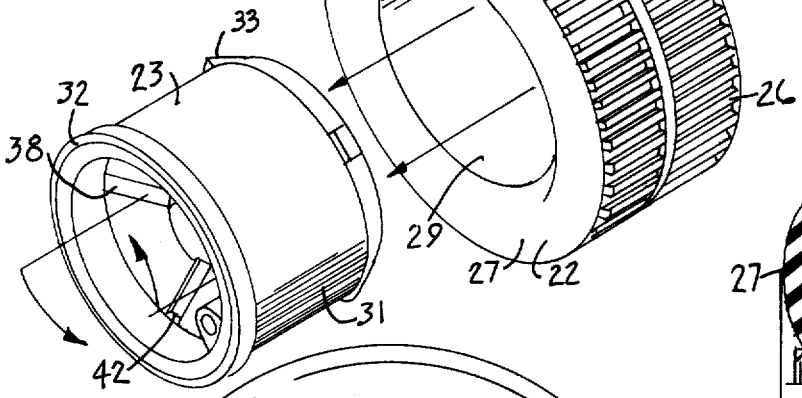
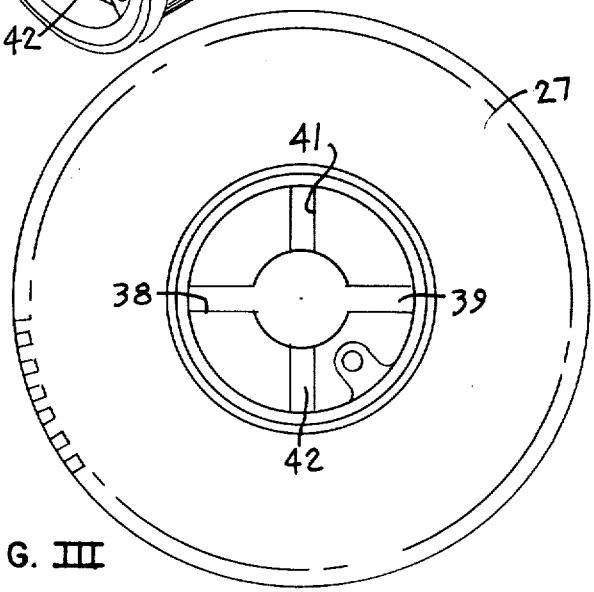
FIG. III
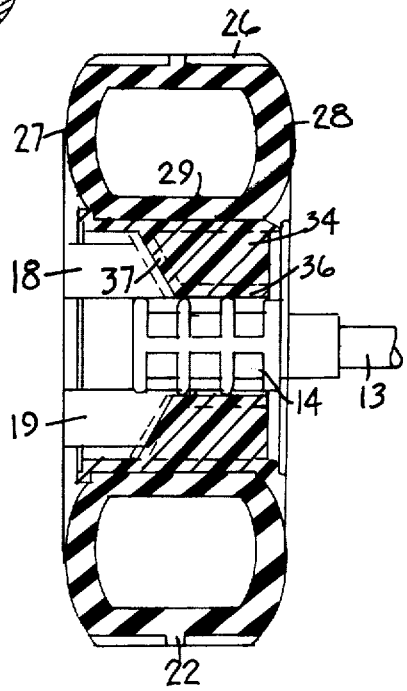
FIG. IV

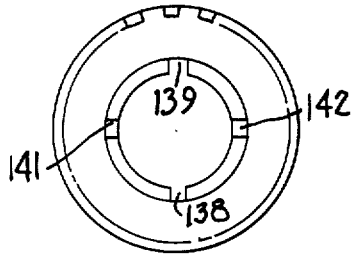
FIG. VI
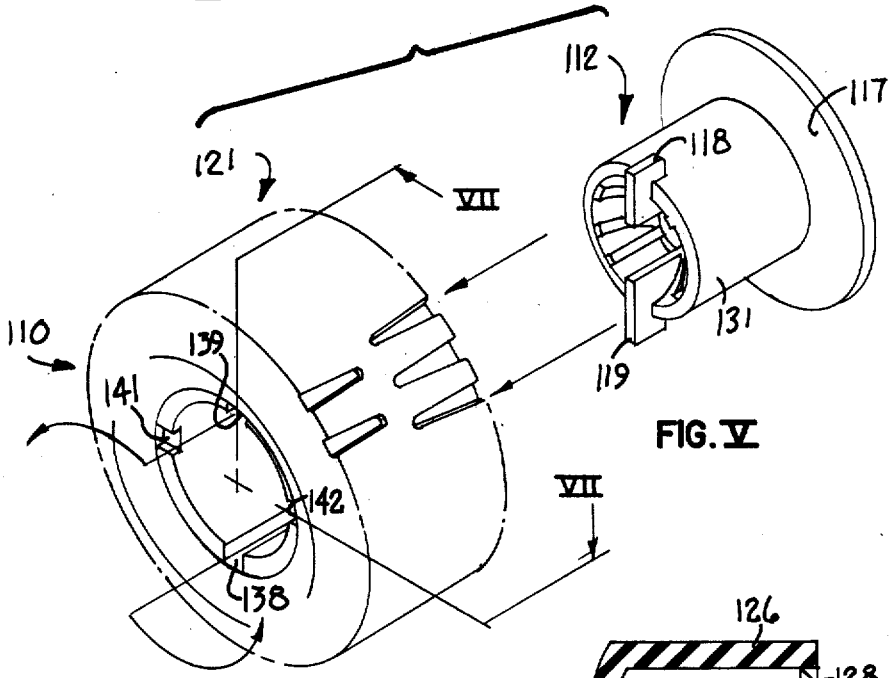
FIG. V
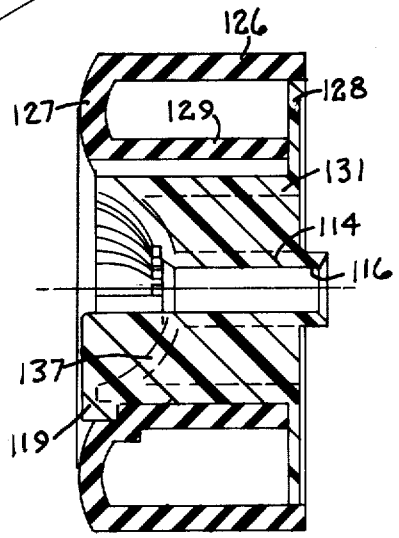
FIG. VII

MOUNTABLE WHEEL FOR TOY VEHICLE

BACKGROUND OF THE INVENTION

The present invention relates to toy non-riding vehicles and more particularly relates to a demountable wheel for use on such toy vehicles.

A wide variety of wheels have been proposed in the past for use on toy vehicles. Early toy wheels, for example, were molded as a single piece and often constructed either of rubber or metal. Later, such wheels were molded of polyethylene or other plastics. At various times improvements were made to such single piece, molded wheels. For example, U.S. Pat. No. 2,940,781 discloses mounting of a hub cap on such a single piece molded wheel.

Another type of wheel construction suggested for use on toy vehicles included a hub such as a plastic material and a rubber tire mounted over such hub. Illustrative of these toy wheels is that shown in U.S. Pat. No. 3,604,756.

Known wheels have generally been permanently mounted on the axle in toy vehicles. Permanent mounting has been provided in many instances by deforming the ends of the axles subsequent to mounting the wheel thereon. In other instances washers and/or keys have been used to lock the wheel on the axle. The washer and key arrangement is disclosed in U.S. Pat. No. 3,907,370. A common approach for securing wheels on axles in toy vehicles has been the use of a cap-like member which securely snaps over the end of the axle after the wheel is in place. Such cap-like members typically are difficult to remove.

One toy vehicle having demountable wheels is disclosed in U.S. Pat. No. 3,924,352. The toy vehicle there disclosed has wheels which are mounted on a hub utilizing a bolt. The toy vehicle is provided with a small electrically powered wrench for removing the bolt. The demountable wheel adds a dimension to the play value of toy vehicles since now the child may mount and remove the tire much as the child's parent may mount or remove the wheels on the family automobile.

Mounting of a toy vehicle wheel utilizing a bolt has certain inherent disadvantages. For example, the bolt requires special tools to enable the child to mount and remove the tire. Further, a bolt may become too tightly secured in place and the child finds it difficult or impossible to remove the bolt.

GENERAL DESCRIPTION OF THE PRESENT INVENTION

The present invention provides a toy wheel which may be easily mounted or removed with no special tools required. The present invention provides a wheel which may be uniformly removed regardless of the number of times the wheel is removed.

The present invention relates to a wheel suitable for use on toy vehicles and including a first wheel member which is rotatably mounted on a toy axle in a permanent or semi-permanent arrangement. This first member may comprise the entire hub of the toy wheel or may alternatively be a spindle on which the hub of the toy wheel may be mounted. In either case, the first member may include a flange or flanges which serve to hold the remainder of the wheel in place when in the mounted condition.

The toy wheel has a second member which includes the tire portion and may also include a tire hub in certain instances. The second member includes a slot or slots through which the aforementioned flange or flanges may be inserted with the flanges extending beyond the adjacent surfaces of the second wheel member. The second member is locked on the first member by rotating the second member a partial turn with respect to the first member. The present invention may be further understood by consideration of the following drawings and associated description.

IN THE DRAWINGS

FIG. 1 is a perspective view of a toy vehicle including the wheel of the present invention;

FIG. II is an exploded view of the wheel of the present invention;

FIG. III is a plan view of a portion of the wheel of the present invention;

FIG. IV is a cross-sectional view of the present wheel structure;

FIG. V is an exploded view of an alternate embodiment of the present invention;

FIG. VI is a plan view of a portion of the wheel of FIG. V; and

FIG. VII is a cross-sectional view o the wheel of FIG. V.

DETAILED DESCRIPTION OF THE PRESENT INVENTION

The wheel 10 (FIG. I) of the present invention may be utilized on any of various toy vehicles such as the pickup truck 11. Although the wheel 10 is shown in conjunction with a pickup truck, it is to be recognized that the present wheel may be used in conjunction with various other vehicles such as toy passenger cars, vans, gravel trucks, farm tractors and the like.

The toy wheel 10, as shown in FIGS. II–IV, may include first a member 12 which is adapted for permanent or semi-permanent mounting on an axle 13 in rotatable engagement therewith. The member 12 may be secured on the axle 13 by conventional means such as a key or a cap-like locking device which permits the member 12 to rotate on axle 13 but prevents the member 12 from being removed from the axle 13.

The member 12 may be a spindle including a cylindrical portion 14 made up of a plurality of rib-like structures such as **14*a* and 14*b* and an inner cylindrical wall portion 14*c*. A cylindrically shaped opening 16 for reception of axle 13 is defined in portion 14. Member 12 further includes a disc-like portion 17 which may be integral with portion 14. Portion 17 is slightly flexible and acts as a spring. Member 12 has a pair of flanges or ears 18 and 19 which also are integral with member 14. The member 12** may be formed by any suitable method such as by molding of a thermal plastic material.

The wheel 10 has a second member 21 which in the embodiment of FIGS. II–IV is a two piece member including a tire portion 22 and a hub portion 23. The tire portion 22 may include radially outer wall 26 having a tread **26*a* defined thereon. The tire portion 22 has a pair of side walls 27 and 28 and a radially inner wall 29. The tire portion 22**, for example, may be manufactured by blow molding techniques and may be of any suitable plastic material such as polyethylene.

The hub portion 23 of member 21 may have an outer cylindrical wall 31, an outer flange or annular ring 32 and a plurality of projections or catches 33. Appropriate space is provided between the annular ridge 32 and projections 33 to snuggly hold the tire portion 22 therebetween. The inner structure of portion 23 may include a plurality of radially inwardly extending fins or wall structures 34, an inner cylindrical wall 36 and a funnel-shaped wall 37. A pair of slots 38 and 39 are defined extending through the inner structure of hub 23. The slot-like openings 38 and 39 are of an appropriate size to receive flanges 18 and 19 therethrough. The funnel-shaped wall 37 also has a pair of slot-like recesses 41 and 42 defined therein. Also the inner diameter of wall portion 36 is appropriate for reception of portion 14 of member 12. It is to be noted that the rear portions 18*a* and 19*a* are tapered to correspond with the slope of wall 37 and slot-like recesses 41 and 42. In the mounted position rear flange portions 18*a* and 19*a* lie in recesses 41 and 42.

MOUNTING OF THE PRESENT WHEEL STRUCTURE

Although the mounting and use of wheel 10 is apparent from the preceding description, it will be further described hereinafter to provide an even more complete description. The wheel member 12 may be first permanently or semi-permanently mounted upon the axle 13 in rotatable engagement therewith. In other words, axle 13 is inserted through opening 16 in member 12. The locking member such as a small cotter key or preferably a cap-type keeper 20 is secured to the shaft 13 thereby holding member 12 in place. The tire portion 22 is mounted upon hub 23 by snapping the tire 22 over the projections 33 until the tire 22 is snuggly held between annular ring 32 and projections 33. The wheel member 21 is then mounted on the spindle 12 by moving the flanges 18 and 19 through the respective slots 38 and 39 until the axially inner side of member 21 is adjacent disc-like portion 17. The disc-like portion or plate 17 serves as a spring or resilient member to limit the distance the flanges 18 and 19 may be moved with respect to member 21. In other words, the ring or flange 17 contacts the axially inner end of hub wall 31 just before the rear portions 18*a* and 19*a* pass beyond wall 37. A slight inward force exerted on the member 21 overcomes the resiliency of plate 17 thus permitting flanges 18 and 19 to pass just beyond the wall 37. The member 21 is then rotated a partial turn with respect to member 12 until the flanges 18 and 19 are aligned with the slot-like recesses 41 and 42 at which time the inward pressure is released. The flanges 18 and 19 then lie partially within the recesses 41 and 42. The recesses 41 and 42 thus lock the member 21 to member 12. In this position the wheel 10 is fully mounted.

If the child now decides to dismount the wheel, a slight inward pressure is applied thus overcoming the force of flange or plate 17 thereby moving flanges 18 and 19 out of the recesses 41 and 42. The member 21 may then be rotated with respect to member 12 until flanges 18 and 19 align with the slot-like openings 38 and 39. The member 21 may then be moved axially outwardly and separated from member 12. This sequence may be repeated many times during play.

AN ALTERNATE EMBODIMENT

An alternate embodiment 110 is illustrated in FIGS. V-VII. The wheel structure 110 is constructed in two pieces including a first member 112 and a second member 121. The member 112 is a hub portion and includes a cylindrical wall portion 131, an inner wall portion 114 and an inwardly tapering side wall portion 137. The inner wall 114 defines a cylindrical opening 116 through which an axle (not shown) may be inserted. The member 112 may be held on the axle by any suitable arrangement. The member 112 may include a pair of flanges 118 and 119 and a radially extending disc portion or flange 117. The member 121 resembles a tire portion and includes an inner wall 129, an outer wall 126 and side walls 127, 128. The tire portion 121 includes a pair of slot-like openings 138 and 139 as well as a pair of slot-like recesses 141 and 142. The tire member 121 may be mounted upon hub member 112 by moving flanges 118 and 119 along the slot-like openings 138 and 139. Slight inward force on tire 121 forces the spring-like flange 117 inwardly and thereby permitting the flanges 118 and 119 to exit through openings 138 and 139. The tire member 121 is then rotated with respect to member 112 until flanges 118 and 119 correspond with recesses 141 and 142. The inward pressure is then released and flanges 118 and 119 come to rest in recesses 141 and 142. The tire member 121 is thus locked with respect to member 112.

The tire 121 may be removed by applying inward pressure until flanges 118 and 119 are just beyond the recesses 141 and 142 at which time tire 121 is rotated until flanges 118 and 119 correspond or align with the slot-like openings 138 and 139. The tire 121 may then be pulled outwardly thereby separating the tire 121 from the hub member 112.

Various modifications can be made without departing from the broader scope of the present invention as defined in the following claims. For example, the flange-like spring member 117 may be replaced with other types of resilient members such as a coil spring. Also, the flanges 118 and 119 may be replaced with a single flange or alternatively with three or more flanges providing corresponding openings are provided in the tire 121.

What is claimed is:

1. An easily mountable and demountable wheel suitable for use on toy vehicles, said wheel comprising:

a. first wheel means including rotatable support means adapted for at least semi-permanent mounting on an axle, spring means comprising a resilient disc-like portion integral with said support means, and first quick release twist locking means, said first locking means comprising a pair of oppositely extending flange means, said flange means being integral with said support means; and b. second wheel means releasably mounted on said first wheel means including tire means and second quick-release locking means for engagement with said first locking means, said second wheel means including hub means, said tire means being mounted on said hub means in semi-permanent locking engagement, entrapped between said resilient portion and said oppositely extending flange means, said flange means being movable between a locking position and a non-locking position with respect to said second wheel means and said hub means being easily removably mounted on said support means.

2. The wheel of claim 1 wherein said second wheel means includes a pair of oppositely extending non-locking slots through which said flange means may be inserted to the non-locking position and a pair of locking slots in which said flange means may be positioned when in said locking position.

3. The wheel of claim 2 wherein said locking slots are defined in an exposed side wall of said tire means.

4. The wheel of claim 1 wherein said first wheel means comprise spindle means adapted for insertion into said second wheel means.

5. An easily mountable and demountable wheel suitable for use on toy vehicles, said wheel comprising:

a. first wheel means including rotatable support means adapted for mounting on an axle, a disc-like spring portion integrally mounted on said support means and a first quick-release twist locking means, said first locking means comprising radially extending, axially aligned flange means; and b. second wheel means including tire means with an opening defined therein for reception of at least a portion of said first wheel means, said second wheel means having axially aligned slot means defined therein through which said flange means may be moved, said second wheel means being rotatable with respect to said first wheel means to a position where said second wheel means is retained on said first wheel means between said disc-like spring portion and said flange means.

6. The wheel of claim 5 wherein said support means comprise wheel hub means.

7. An easily mountable and demountable wheel suitable for use on toy vehicles, said wheel comprising:

a. first wheel means including rotatable support means adapted for at least semi-permanent mounting on an axle, radially extending spring flange means, and first quick-release twist locking means, said first locking means comprising radially extending axially aligned means; and b. second wheel means releasably mounted on said first wheel means including tire means having axially aligned slot means and second quick-release locking means for engagement with said first locking means, said radially extending axially aligned locking means being rotatable a partial turn with respect to said second wheel means between a locking position and a non-locking position, said second wheel means including hub means, said tire means being mounted on said hub means in semi-permanent locking engagement between said spring flange means and said first locking means and said hub means being easily removably mounted on said support means.

8. An easily mountable and demountable wheel suitable for use on toy vehicles, said wheel comprising:

a. first wheel means including rotatable support means adapted for mounting on an axle, said support means comprising spindle means having radially extending resilient flange means adjacent a first end and first quick-release twist locking means adjacent the opposite end; and b. second wheel means including tire means and second quick-release locking means for engagement with said first locking means, said tire means being mounted on said hub means in semi-permanent locking engagement entrapped between said resilient flange means and said twist locking means, and said hub means being easily removably mounted on said support means.

9. The wheel means of claim 8 wherein said hub means includes slot recess means for reception of said flange-like extensions.

10. The wheel means of claim 8 wherein said hub means includes a first set of slots for reception of said flange-like extensions into a non-locking position and a set of slot recesses to which said extensions may be moved being there positioned in locking engagement.

11. A wheel and axle structure for use on toy vehicles, said wheel and axle structure comprising:

an axle;

a spindle permanently mounted on said axle for rotatable engagement therewith, said spindle including a cylindrical portion, a plurality of outwardly extending ears adjacent one end of said cylindrical portion and a disc-like portion extending outwardly adjacent the other end of said cylindrical portion, said disc-like portion being resiliently flexible to serve as spring means;

means for permanently securing said spindle on said axle; and wheel means including a tire portion and a hub portion, said hub portion having a cylindrical opening defined in the center thereof for reception of said spindle, said hub further including a plurality of slot-like openings through which said ears may pass, said hub further including a plurality of slot-like recesses spaced from said slot-like openings;

whereby said spindle is permanently mounted for rotation on said axle and said wheel means are removably mounted on said spindle by aligning the cylindrical opening in the hub portion with the cylindrical portion of the spindle and aligning the slot-like openings in said hub with the ears of said spindle, sliding said wheel means axially onto said spindle resiliently deforming said disc-like portion to urge said ears axially outwardly of said hub rotating said wheel means until said ears align with said slot-like recesses and releasing said wheel means to a locked position with said ears lying in said slot-like recesses.

* * * * *